US010044148B2

(12) United States Patent
Zhao

(10) Patent No.: US 10,044,148 B2
(45) Date of Patent: Aug. 7, 2018

(54) ELECTRICAL CONNECTOR WITH ADHESIVE LAYER COVERING SEAM OF MAIN SHELL

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/844,656

(22) Filed: Dec. 18, 2017

(65) Prior Publication Data

US 2018/0175556 A1 Jun. 21, 2018

(30) Foreign Application Priority Data

Dec. 19, 2016 (CN) ..... 2016 1 1176661

(51) Int. Cl.

| | |
|---|---|
| ***H01R 24/00*** | (2011.01) |
| ***H01R 13/6581*** | (2011.01) |
| ***H01R 13/502*** | (2006.01) |
| ***H01R 13/52*** | (2006.01) |
| *H01R 12/72* | (2011.01) |
| *H01R 13/6594* | (2011.01) |
| *H01R 13/6585* | (2011.01) |

(52) U.S. Cl.

CPC ..... *H01R 13/6581* (2013.01); *H01R 13/502* (2013.01); *H01R 13/5202* (2013.01); *H01R 13/5216* (2013.01); *H01R 12/722* (2013.01); *H01R 13/6585* (2013.01); *H01R 13/6594* (2013.01)

(58) Field of Classification Search

CPC ..... H01R 13/6581; H01R 13/502; H01R 13/5202; H01R 13/5216; H01R 13/6585; H01R 12/722; H01R 13/6594

USPC ..... 439/78, 607.35, 660, 936

See application file for complete search history.

(56) References Cited

U.S. PATENT DOCUMENTS

| | | | | |
|---|---|---|---|---|
| 9,627,796 | B2 * | 4/2017 | Tsai | H01R 13/5202 |
| 9,887,485 | B2 * | 2/2018 | Lambie | H01R 13/5219 |
| 9,899,779 | B1 * | 2/2018 | Lin | H01R 24/60 |
| 2017/0149165 | A1 * | 5/2017 | Tsai | H01R 13/52 |
| 2017/0155216 | A1 * | 6/2017 | Yao | H01R 24/60 |

FOREIGN PATENT DOCUMENTS

| | | |
|---|---|---|
| TW | I552455 B | 10/2016 |

* cited by examiner

*Primary Examiner* — Khiem Nguyen

(74) *Attorney, Agent, or Firm* — Wei Te Chung; Ming Chieh Chang

(57) ABSTRACT

An electrical connector includes a contact module enclosed within a metallic main shell. The contact module includes an insulative housing and a plurality of contacts retained in the housing. The housing includes a base and a tongue portion extending forwardly from the base. The main shell is formed by stamping and forming, and includes opposite first and second side walls, and a pair of end walls linking the opposite first and second side walls. The shell forms a mating cavity enclosing the tongue portion. A seam is formed on the second side wall. An adhesive layer is applied upon an exterior surface of the second side wall to cover the seam for providing a waterproof function. A metallic sub-shell is attached upon the adhesive layer.

18 Claims, 6 Drawing Sheets

ELECTRICAL CONNECTOR WITH ADHESIVE LAYER COVERING SEAM OF MAIN SHELL

FIELD OF THE DISCLOSURE

The invention is related to an electrical connector, and particularly to the connector with an adhesive layer applied upon the seam of the main shell and the sub-shell applied upon the adhesive layer.

DESCRIPTION OF RELATED ARTS

Taiwan Patent No. I552455 discloses the electrical connector with a waterproof ring surrounding the metallic shell. Anyhow, the water may invade the interior of the electrical connector or the electronic device through the seam of the shell.

It is desired to provide a connector with a reliable waterproof performance.

SUMMARY OF THE DISCLOSURE

To achieve the above desire, an electrical connector includes a contact module enclosed within a metallic main shell. The contact module includes an insulative housing and a plurality of contacts retained in the housing. The housing includes a base and a tongue portion extending forwardly from the base. The main shell is formed by stamping and forming, and includes opposite first and second side walls, and a pair of end walls linking the opposite first and second side walls. The shell forms a mating cavity enclosing the tongue portion. A seam is formed on the second side wall. An adhesive layer is applied upon an exterior surface of the second side wall to cover the seam for providing a waterproof function. A sub-shell is further attached upon the adhesive layer. The main shell provides spring tangs for engagement with the complementary plug connector which is inserted into the mating cavity, and the sub-shell provide mounting legs for mounting to a printed circuit board.

DETAILED DESCRIPTION OF THE PREFERRED EMBODIMENT

Figure 1:
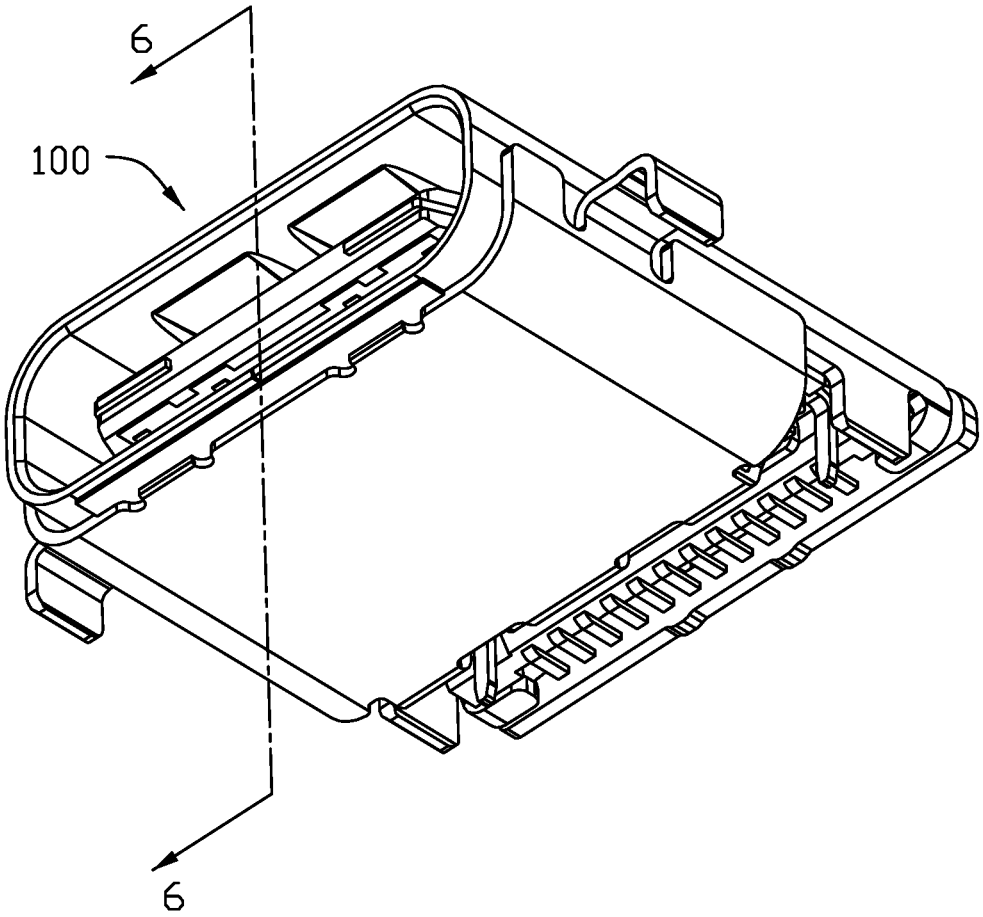
FIG. 1 is a perspective view of the electrical connector of the invention.
Figure 2:
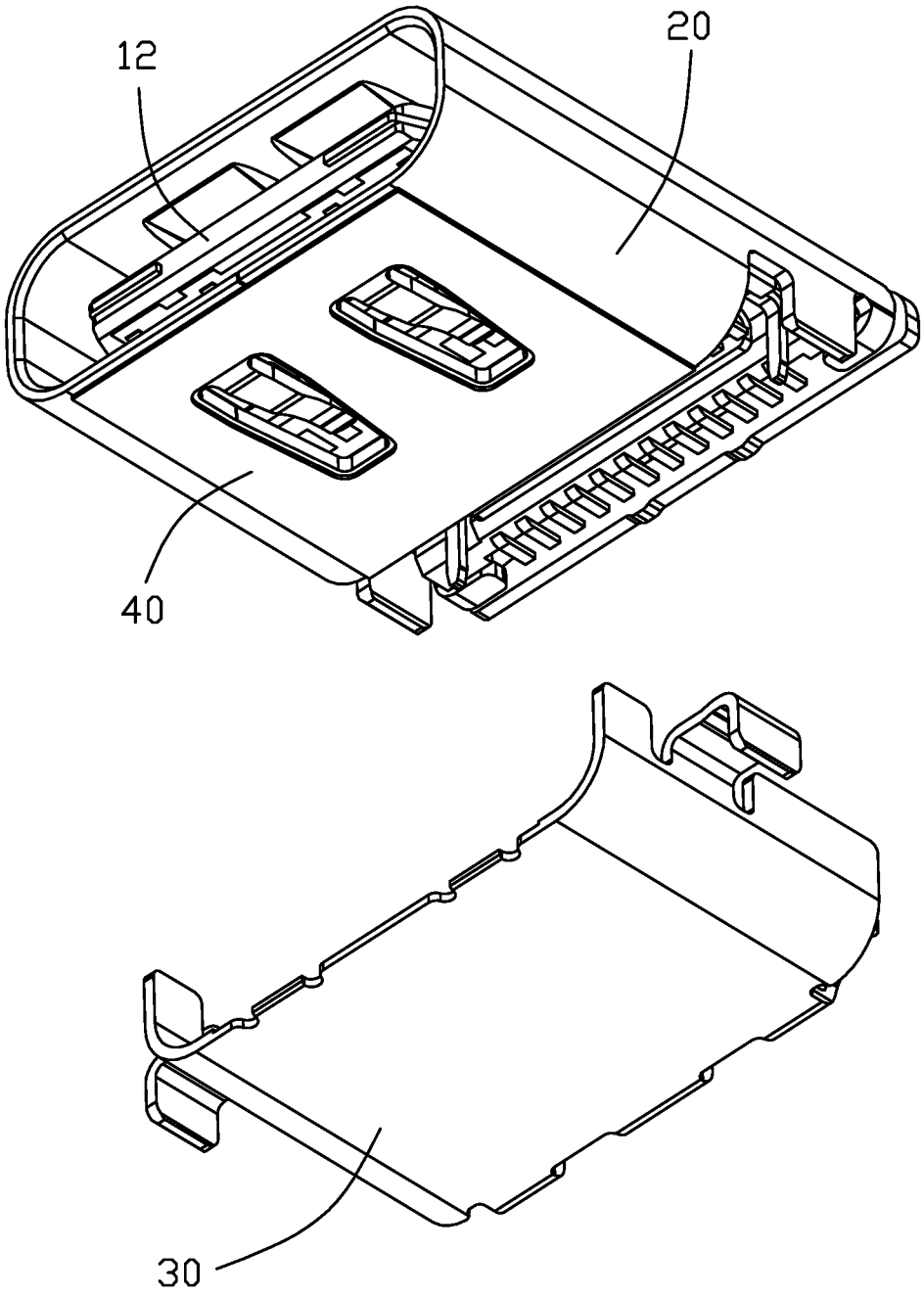
FIG. 2 is an exploded perspective view of the electrical connector of FIG. 1.
Figure 3:
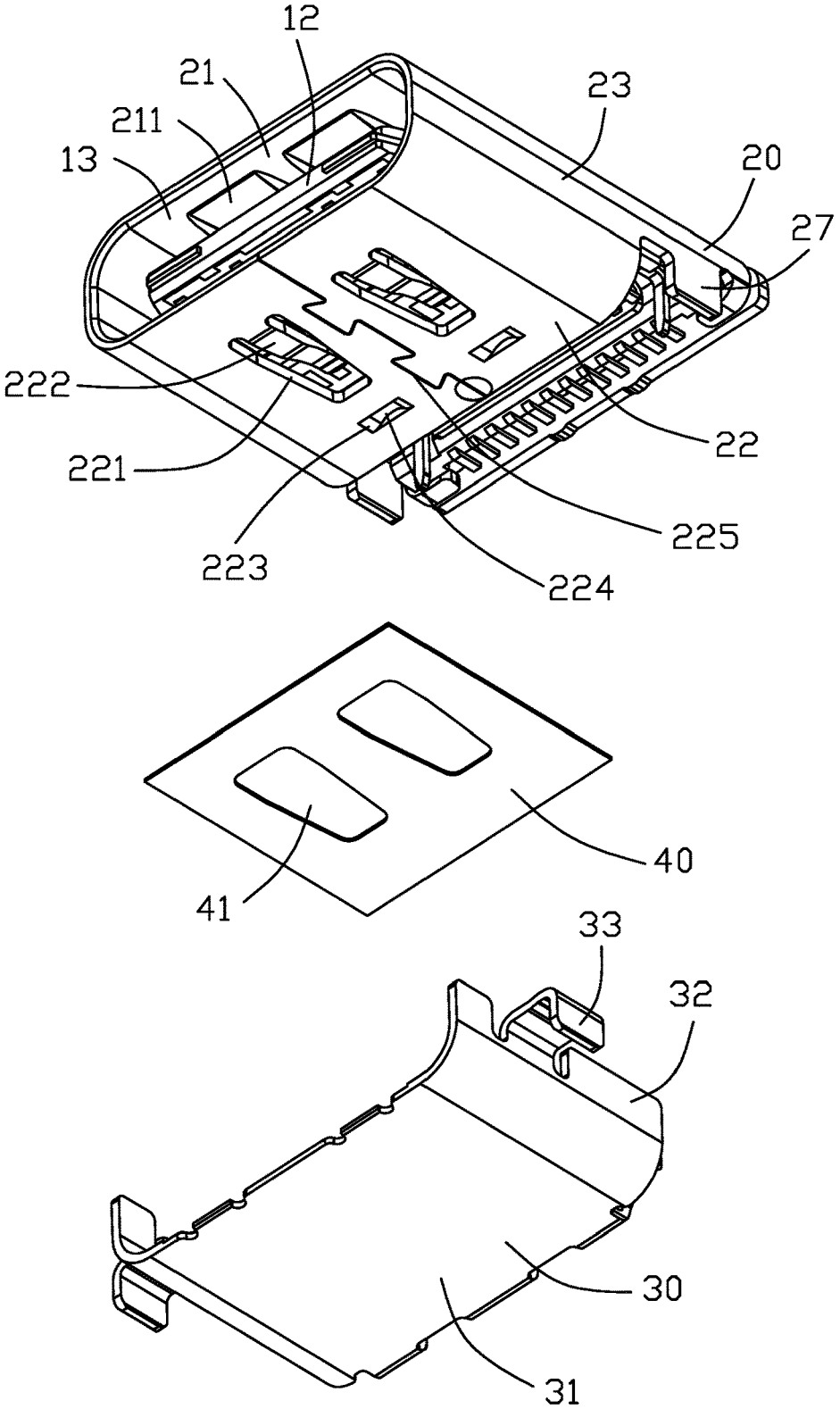
FIG. 3 is a further exploded perspective view of the electrical connector of FIG. 2.
Figure 4:
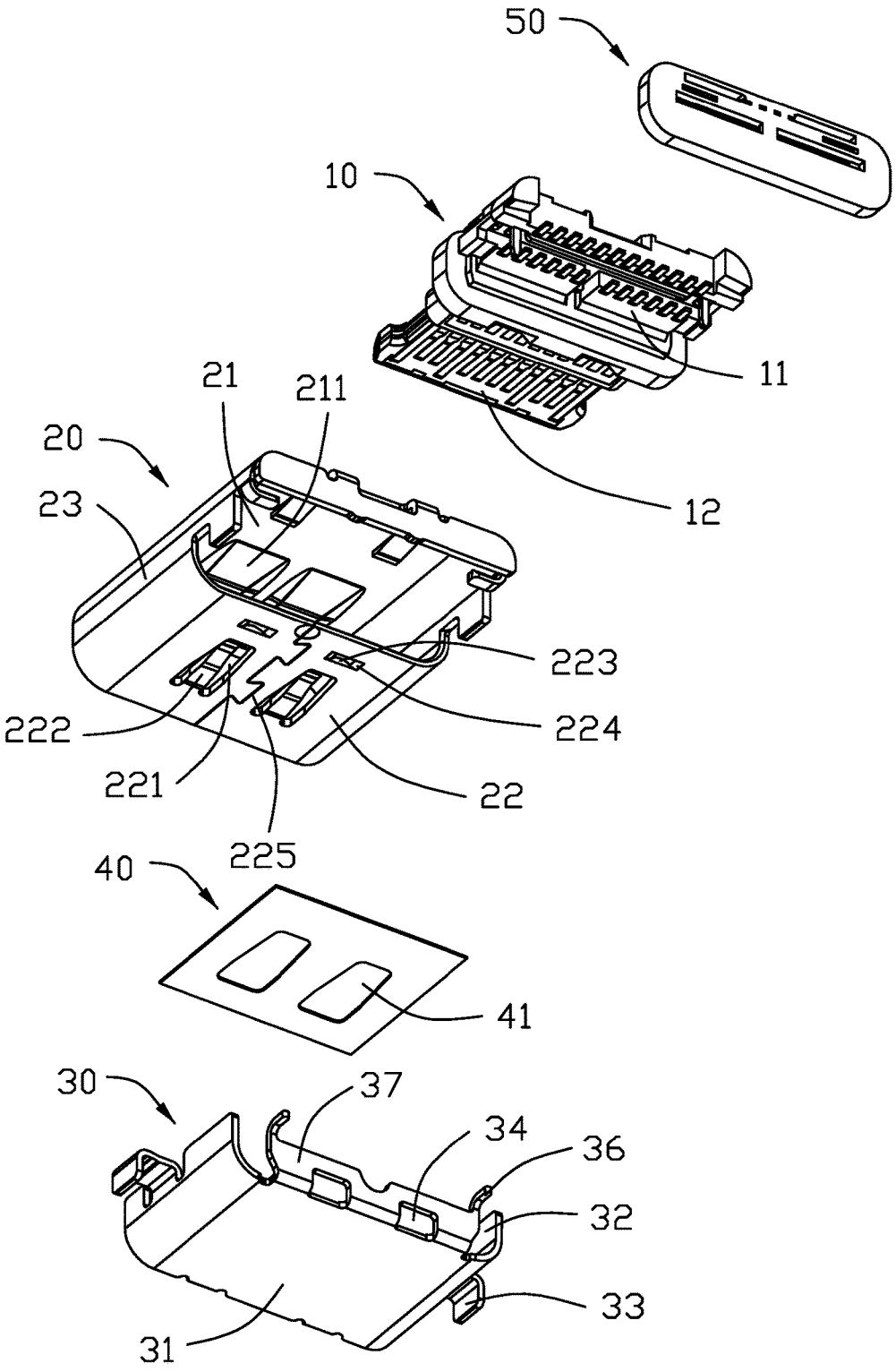
FIG. 4 is a further exploded perspective view of the electrical connector of FIG. 3.
Figure 5:
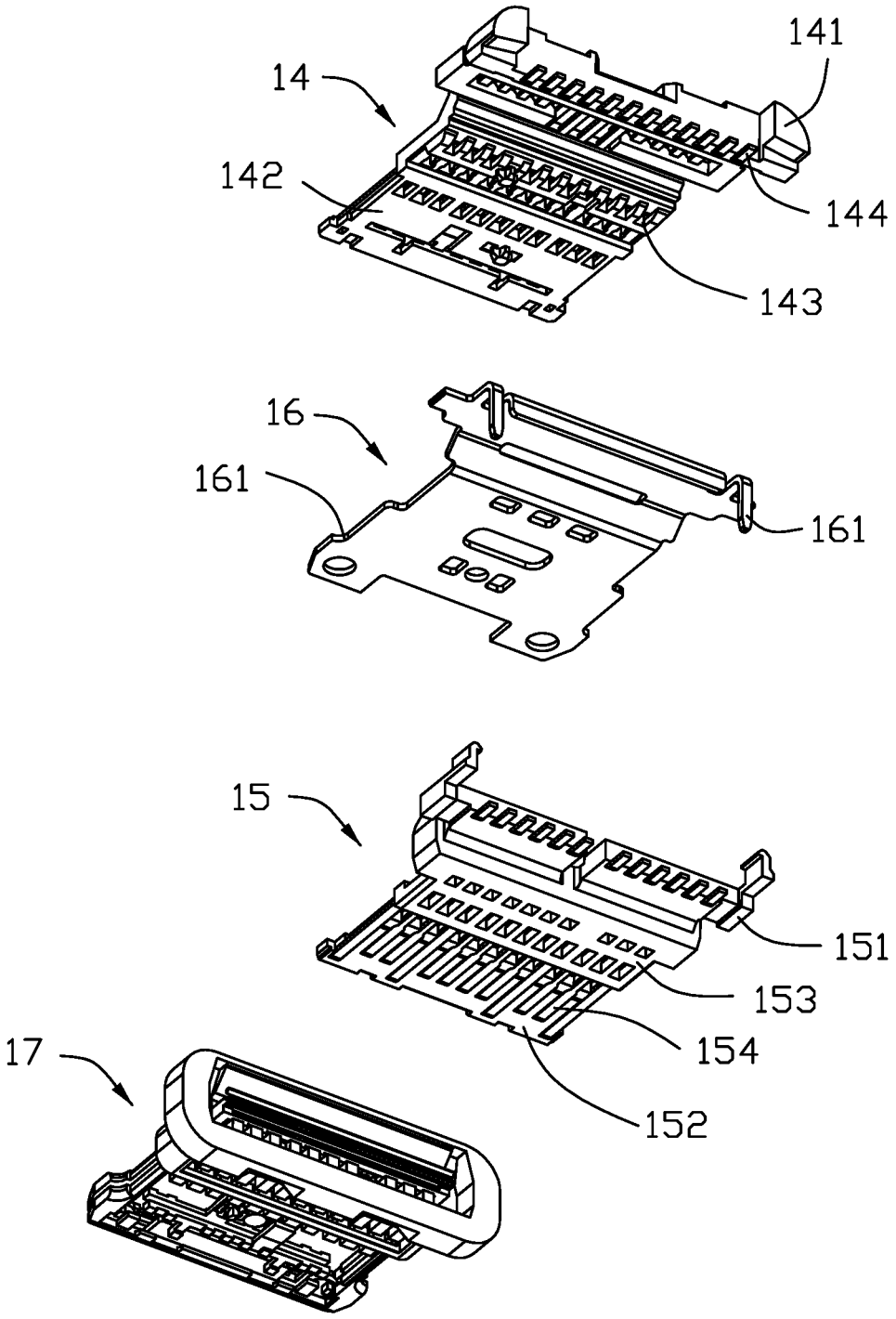
FIG. 5 is an exploded perspective view of the electrical connector of FIG. 1.
Figure 6:
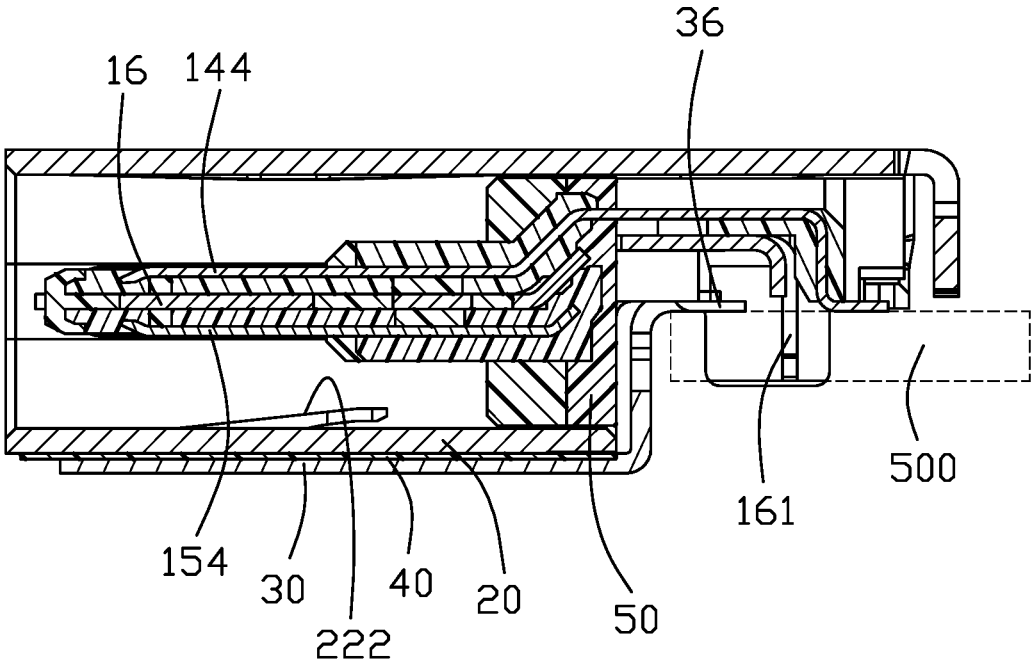
FIG. 6 is a cross-sectional view of the electrical connector of FIG. 1.

Reference will now be made in detail to the embodiments of the present disclosure. Referring to FIGS. 1-6, an electrical connector 100 is mounted to a printed circuit board 500 wherein the printed circuit board 500 forms a notch in a front edge in which the connector 100 is disposed. The printed circuit board 500 is essentially located at a mid-level of the electrical connector 100. The electrical connector 100 includes a contact module 10 enclosed within a metallic first/main shell 20, and a second/sub-shell 30 attached upon an exterior side of the main shell 20. The contact module 10 includes an insulative housing (not labeled) composed of a base 11 and a tongue portion 12 extending forwardly from the base 11. The main shell 20 encloses the tongue portion 12 to form a mating cavity 13. The sub-shell 30 includes an upstanding back plate 37 with therein a pair of through holes 34 through which the liquid glue flows to a back side of the connector 100 to form a waterproof plate 50 which is attached upon a rear face of the housing and communicates with the seam 225 (illustrated later) in a vertical direction.

The contact module 10 includes a first terminal module 14, a second terminal module 15 and a metallic shielding plate 16 therebetween. The first terminal module 14 includes a first insulator 141 with a plurality of first contacts 144 integrally formed therein via an insert-molding process. The first insulator includes a first base 143 and a first tongue portion 142 extending forwardly from the first base 143. The second terminal module 15 includes a second insulator 151 and a plurality of second contacts 154 integrally formed within the second insulator 151 via another insert-molding process. The second insulator 151 includes a second base 153 and a second tongue portion 152 forwardly extending from the second base 153. The first terminal module 14 and the second terminal module 15 are assembled together with the shielding plate 16 therebetween as a sub-assembly to be overmolded with a third insulator 17 upon the assembled first base 143/second base 153, and the assembled first tongue portion 142/second tongue portion 152, to form the complete contact module 10.

The main shell 20 includes a first side wall 21 and a second side wall 22 opposite to the first side wall 21, a pair of end walls 23 linking the first side wall 21 and the second side wall 22. Because the main shell 20 is formed by stamping and forming from sheet metal, a seam 225 is inevitably formed on the second side wall 22. An adhesive layer 40 is applied upon an exterior surface of the second side wall 22 to cover the seam 225. The second side wall 22 forms a pair of spring tangs 222 extending from corresponding holes 221, and the adhesive layer 40 forms corresponding through holes 41 aligned with the corresponding holes 221 for allowing deflection of the corresponding spring tangs 222 so the spring tangs 222 may touch the sub-shell 30, if necessary. The second side wall 22 further includes a pair of recesses 223 with corresponding protrusions 224 extending toward the base 11 to retain the base 11 in position. The adhesive layer 40 covers the recesses 223. The first side wall 21 forms a pair of protruding ribs 211 cooperating with the pair of spring tangs 222 for retaining the complementary plug connector in position in the mating cavity 13.

The sub-shell 30 is attached to the second side wall 22 via the adhesive layer 40. The sub-shell 30 includes a horizontal section 31 and a pair of upstanding sections 32. The horizontal section 31 covers the holes 221 and confronts the spring tangs 222, and the upstanding section 32 forms the corresponding mounting legs 33 for mounting to the printed circuit board 500.

In this embodiment, the shielding plate 16 includes a pair of vertical mounting legs 161 extending through the printed circuit board 500 while the sub-shell 30 includes a pair of horizontal mounting legs 36 seated upon the printed circuit board 500. The main shell 20 also forms a pair of vertical mounting legs 27 extending through the printed circuit board 500.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module including an insulative housing and a plurality of contacts retained in the housing, the housing including a base and a tongue portion extending forwardly from the base along a front-to-back direction;

a metallic main shell enclosing the housing and defining a mating cavity surrounding the tongue portion, said main shell made from sheet metal via stamping and forming and defining a seam extending along a side wall of the main shell; and an adhesive layer applied upon the an exterior surface of said side wall to cover said seam.

2. The electrical connector as claimed in claim 1, wherein said seam extends along the front-to-back direction.

3. The electrical connector as claimed in claim 1, further including a metallic sub-shell attached upon the exterior surface of the side wall to cover the adhesive layer.

4. The electrical connector as claimed in claim 2, wherein the side wall forms at least a hole with a spring tang extending therein toward the mating cavity, and the adhesive layer forms a through hole aligned with said hole in a vertical direction perpendicular to the front-to-back direction so as to allow outward deflection of the spring tang.

5. The electrical connector as claimed in claim 1, wherein the side wall forms at least a recess with a corresponding protrusion extending inwardly to retain the base in position within the main shell.

6. The electrical connector as claimed in claim 1, wherein the adhesive layer covers the recess.

7. The electrical connector as claimed in claim 1, wherein the sub-shell further includes a pair of mounting legs at a lever higher than the side wall in a vertical direction perpendicular to the front-to-back direction.

8. The electrical connector as claimed in claim 1, wherein the contact module includes a first terminal module and a second terminal module commonly sandwiching a metallic shielding plate therebetween in a vertical direction perpendicular to said front-to-back direction.

9. The electrical connector as claimed in claim 1, wherein a waterproof plate made by glue is located on a rear side of the housing, and communicates with the seam in the vertical direction.

10. An electrical connector assembly comprising:

a printed circuit board;

an electrical connector mounted to the printed circuit board wherein the printed circuit board is essentially located at a mid-level of the electrical connector, said electrical connector including:

a contact module having an insulative housing and a plurality of contacts retained in the housing, the housing including a base and a tongue portion extending forwardly from the base along a front-to-back direction;

a metallic main shell enclosing the housing and defining a mating cavity surrounding the tongue portion, said main shell made from sheet metal via stamping and forming and defining a seam extending along a side wall of the main shell; and an adhesive layer applied upon the an exterior surface of said side wall to cover said seam.

11. The electrical connector assembly as claimed in claim 10, further including a sub-shell having a horizontal section attached upon the adhesive layer.

12. The electrical connector assembly as claimed in claim 11, wherein the horizontal section of said sub-shell is located below the printed circuit board.

13. The electrical connector assembly as claimed in claim 12, wherein the main shell includes a hole with a spring tang extending from an edge of the hole into the mating cavity, and the adhesive layer forms a through hole aligned with the hole in a vertical direction perpendicular to the front-to-back direction.

14. The electrical connector assembly as claimed in claim 13, wherein said sub-shell cover directly communicates with the spring tang in the vertical direction.

15. The electrical connector assembly as claimed in claim 13, wherein the sub-shell includes a pair of mounting legs mounted to the printed circuit board.

16. The electrical connector assembly as claimed in claim 15, wherein said pair of mounting legs are located at a rear end of the sub-shell.

17. The electrical connector assembly as claimed in claim 10, wherein the side wall forms at least a recess with a corresponding protrusion extending inwardly to retain the base in position within the main shell.

18. The electrical connector as claimed in claim 17, wherein the adhesive layer covers the recess.

* * * * *